US006194956B1

(12) United States Patent
Barnes

(10) Patent No.: US 6,194,956 B1
(45) Date of Patent: Feb. 27, 2001

(54) LOW CRITICAL VOLTAGE CURRENT MIRRORS

(75) Inventor: William Bryan Barnes, Bristol (GB)

(73) Assignee: STMicroelectronics Limited, Bristol (GB)

( * ) Notice: Subject to any disclaimer, the term of this patent is extended or adjusted under 35 U.S.C. 154(b) by 0 days.

(21) Appl. No.: 09/304,209

(22) Filed: Apr. 29, 1999

(30) Foreign Application Priority Data

May 1, 1998 (GB) ..... 9809438

(51) Int. Cl.[7] ..... G05F 3/02

(52) U.S. Cl. ..... 327/538; 327/541; 323/312; 323/315

(58) Field of Search ..... 327/53, 538, 541, 327/543; 330/288; 323/312, 314, 315

(56) References Cited

U.S. PATENT DOCUMENTS

| | | | | |
|---|---|---|---|---|
| 3,835,410 | | 9/1974 | Wittlinger | 330/19 |
| 5,514,948 | | 5/1996 | Okazaki | 323/314 |
| 5,559,425 | * | 9/1996 | Allman | 323/315 |
| 5,656,968 | * | 8/1997 | Sander et al. | 327/543 |
| 5,672,993 | * | 9/1997 | Runaldue | 327/404 |
| 5,696,440 | | 12/1997 | Harada | 323/315 |
| 5,900,773 | * | 5/1999 | Susak | 327/539 |
| 5,912,580 | * | 6/1999 | Kimura | 327/530 |
| 5,982,227 | * | 11/1999 | Kim et al. | 327/538 |

FOREIGN PATENT DOCUMENTS 0 642 070 B1 3/1995 (EP) .

* cited by examiner

*Primary Examiner*—Timothy P. Callahan
*Assistant Examiner*—An T. Luu
(74) *Attorney, Agent, or Firm*—Theodore E. Galanthay; David V. Carlson; Seed IP Law Group PLLC

(57) ABSTRACT

A current mirror has an input node for receiving an input current and an output node for providing an output current. First, second and third transistors are provided with each transistor having first and second current path terminals and a control terminal. The control terminals of the first and second transistors are connected to each other. The first current path terminal of the first transistor and one of the current path terminals of the second transistor are connected to a power supply. The control terminal of the third transistor is connected to the input node. One of the first and second current path terminals of the third transistor are connected to the output node and the other of the first and second current path terminals of the third transistor are connected to the other of the first and second current path terminals of the second transistor. A resistive element is arranged between the input node and the second current path terminal of the first transistor. The control terminals of the first and second transistors are connected to a node between the resistive element and a second current path terminal of the first transistor. The resistive element is a transistor of the opposite polarity to the first, second and third transistors.

14 Claims, 2 Drawing Sheets

LOW CRITICAL VOLTAGE CURRENT MIRRORS

TECHNICAL FIELD

The present invention relates to current mirrors.

BACKGROUND OF THE INVENTION

Various different current mirrors are known and a simple current mirror 1 is shown in FIG. 1. The simple current mirror 1 comprises first and second n-type field effect transistors (FETs) 2 and 4 which are matched. The source of each of the FETs 2 and 4 is connected to ground. The gates of the two FETs 2 and 4 are connected to one another. The gate and the drain of the first FET 2 are connected to each other. An input node 13 is connected to the drain of the first transistor 2.

The input node 13 receives an input current Iin. This input current Iin gives rise to the voltage at the input node 13. When the voltage is high enough, the first and second transistors 2 and 4 will conduct and the first transistor 2 will source a current equal to Iin. The output of the current mirror 1 is taken from output node 14 which is connected to the drain of the second transistor 4. If the voltage on the output node 14 is above the saturation voltage, the second transistor 4 will source a current Iout similar to or equal to Iin. The input current Iin has thus been "mirrored".

The same voltage at the first node 13 will provide the gate voltages for the first and second transistors 2 and 4.

The voltage required at the output node must be at least equal to the saturation voltage for the input current to be mirrored. In saturation, the following equation applies:

$$Vds\ sat = Vgs - Vt = \Delta V$$

where Vds sat=the saturation voltage

Vgs=gate-source voltage

Vt=threshold voltage.

There are features which can be used to measure the effectiveness of the current mirror:

(i) Critical voltage—that is the minimum required voltage at the output node to obtain current mirroring.

(ii) the incremental output resistance $$Rout = \frac{d(Vout)}{d(Iout)} d(Vout) d(Iout)$$

where Vout is the voltage at the output node and Iout is the current at the output node.

(iii) where the output resistance is high, the accuracy of the mirroring is important. If the output resistance is low, the output current varies with the output voltage and the concept of accuracy is of limited use.

The current mirror of FIG. 1 has a low critical voltage of ΔV, a reasonable output resistance ΔV/Iout.

However, the accuracy is not particularly good. In particular the current mirror shown in FIG. 1 may not be accurate enough for certain applications. With the current mirror shown in FIG. 1, fluctuations in the voltage on the output node 14 can effect the ability of the current mirror 1 accurately to mirror the input current Iin to the output. In particular, if Vout does not equal the voltage at the input node, there will not be perfect current mirroring.

The cascode current mirror 19 has therefore been proposed and this is shown in FIG. 2. The cascode current mirror 19 comprises two matched pairs of n-type FETs. The first and second pairs of FETs do not need to be the same. The first pair of transistors 16 and 18 have the same configuration as the first and second transistors shown in FIG. 1. In other words, the source of each of these transistors 16 and 18 is connected to ground and the gates of the two transistors 16 and 18 are connected together. The gate and the drain of the first FET 16 are connected together. The drain of the first transistor 16 is connected to the source of the third transistor 24.

The gates of the third and fourth transistors 24 and 26, making up the second pair of transistors, are connected to one another. The gate and drain of the third transistor 24 are connected. A current Iin is input via a first node 30 connected to the drain of the third transistor 24. The drain of the second transistor 18 is connected to the source of the fourth transistor 26. The output current Iout is taken from an output node 31 which is connected to the drain of the fourth transistor 26.

When a current Iin is received via the first node 30, the third and fourth transistors 24 and 26 will conduct if the voltage is high enough. The current is therefore conducted through the third transistor 24. If the voltage on the drain and gate of the first transistor 16 is large enough, the first and second transistors 60 and 80 will conduct. The arrangement of FIG. 2 allows the output current Iout at the output node 31 to be similar to or equal to the input current Iin. This is because a near constant voltage is maintained for the second transistor 18 by the fourth transistor 26. The drain voltages of the first and second transistors are kept at very similar levels. If the drain voltages differ, then the quality of the current mirroring decreases. Changes in the output voltage do not effect the drain voltage of the second transistor 18 as much as in the arrangement of FIG. 1. This is due to the presence of the fourth transistor 26.

However, because there are two additional transistors in the cascode mirror, as compared to the simple current mirror shown in FIG. 1, the critical voltage required for the cascode mirror to operate is much larger than for the simple current mirror of FIG. 1. The critical voltage=ΔV (for the second transistor 18)+Vgs (for the fourth transistor)=ΔV+(ΔV+Vt)=2ΔV+Vt. This is assuming that all four transistors have the same characteristics. Rout is good as is the accuracy.

The Wilson current mirror is similar to the cascode current mirror of FIG. 2 but only has three transistors. This has the same problems as the cascode current mirror. The Wilson current mirror would require a critical output voltage similar to that required by the cascode current mirror.

A third known arrangement is called the scaled Ids current mirror 49 and is shown in FIG. 3. Ids is the drain source current. The scaled Ids mirror 49 resembles the cascode current mirror and has four N-type transistors. The first and second transistors 50 and 52 constitute the first pair and the third and fourth transistors 54 and 56 constitute the second pair. The first and second transistors 50 and 52 are a matched pair. Whilst the third and fourth transistors 54 and 56 may be a matched pair, as will be discussed hereinafter, it is preferred that these transistors are not in fact matched. The first and third transistors 50 and 54 are on the input side whilst the second and fourth transistors 52 and 56 are on the output side.

In contrast to the cascode mirror shown in FIG. 2, each of the input transistors, the first and third transistors 50 and 54, is arranged to receive its own input current. The first transistor 50 receives via its drain a first input current Iin1. The third transistor is arranged to receive a second input current Iin2, also via its drain. The sources of the first and second transistors 50 and 52 are connected to ground. The gates of the first and second transistors 50 and 52 are connected to each other. The gate of the first transistor 50 is connected to its drain.

The source of the third transistor 54 is connected to ground. The gate of the third transistor 54 is connected to the gate of the fourth transistor 56 and to the drain of the third transistor 54. The third transistor is not in series with the first transistor, as in the cascode current mirror. Rather, the source of the third transistor 54 is connected directly to ground. This means that the voltage required at the drain of the third transistor is smaller than that required on for example the drain of corresponding transistor of the cascode current mirror, for similarly sized transistors. This reduces the minimum voltage required at the output.

The current mirror 49 shown in FIG. 3 provides a good performance when the current density in the first transistor 50 is four times that to the current density in the third transistor 54. In other words, the ratio of the width to length of the channel in the first transistor is four times the ratio of the width to the length of the channel in the third transistor 54. The first, second and fourth transistors 50, 52 and 56, in this particular embodiment, share the same characteristics. This gives rise to the following equation:

(Vgs-Vt) for the third transistor 54=2×(Vgs-Vt) for the first transistor 50.

The critical voltage for the output node 59 is then (Vgs-Vt) for the second transistor 52+(Vgs-Vt) for the fourth transistor=2ΔV as Vgs-Vt is the same for first, second and fourth transistors.

This provides better performance than the cascode current mirror in that the critical voltage is smaller. The drain voltage of the second transistor 52 is set by the third transistor 54 and the gate voltage is set by the first transistor 50. The gate voltage of the fourth transistor 56 can be reduced without disturbing the drain voltage of the second transistor 52. However, the arrangement shown in FIG. 4 has the disadvantage that two equal or scaled input currents are required. This may be undesirable in certain applications. The accuracy is reduced but Rout is good.

SUMMARY OF THE INVENTION

It is an aim of embodiments of the present invention to provide a current mirror which has the advantages, for example of the cascode or Wilson current mirror but which has a lower critical voltage requirement.

According to one aspect of the present invention, there is provided a current mirror comprising an input node for receiving an input current; an output node for providing an output current; first, second and third transistors, each transistor comprising first and second current path terminals and a control terminal, the control terminals of the first and second transistors being connected to each other, the first current path terminal of the first transistor and one of the current path terminals of the second transistor being connected to a power supply, the control terminal of the third transistor being connected to the input node, one of the first and second current path terminals of the third transistor being connected to the output node and the other of the first and second current path terminals of the third transistor being connected to the other of the first and second current path terminals of the second transistor; and a resistive element arranged between the input node and the second current path terminal of the first transistor, the control terminals of the first and second transistors being connected to a node between the resistive element and the second current path terminal of said first transistor, said resistive element being a transistor of the opposite polarity to the first, second and third transistors.

The provision of the resistive element between the input node and the second current path is advantageous. In particular, the resistive element causes a saturation voltage to be applied to the control terminal of the third transistor so that the critical voltage required on the output side in order to maintain the correct operation of the mirror is much lower than for example, in a cascode current mirror or a Wilson current mirror, for similarly sized transistors. The resistive element provides some compensation for changes in temperature caused by changes in temperature in the environment and/or changes in the input current. The power supply is preferably ground.

Preferably, the resistive element comprises a resistor. In certain applications, the use of a resistor is advantageous in that it is low cost and can provide reasonable biasing for the third transistor over a range of input currents. The resistor may not provide optimum biassing over a particularly wide range of currents but may be adequate in certain situations.

Alternatively, the resistive element comprises a load transistor which may be of the opposite polarity to the first, second and third transistors. Alternatively the load transistor may be of the same polarity as the first to third transistors. The effective resistance of the load transistor will not perfectly track the changes in the first and second transistors caused by changes in the value of the input current and/or temperature but will do so over a wider range of input currents than if the resistive element were a resistor.

Preferably, the first, second and third transistors are n-type transistors. Thus, the resistive element may be a p-type transistor with its control terminal connected for example to ground. In alternative embodiments of the present invention, the first second and third transistors may be p-type. The resistive element may then be an n-type transistor or p type if the load transistor is to be of the same polarity as the first to third transistors.

A fourth transistor may be provided with one of its current path terminals connected to the second current path terminal of the first transistor and the other of the current path terminals of the fourth transistor being connected to one end of the resistive element. This has the advantage that the accuracy of the mirror is improved. The control terminal of the fourth transistor may be connected to the control terminal of the third transistor. The fourth transistor may be connected between the second current path terminal of the first transistor and the input node.

The first and second transistors may be matched. Alternatively or additionally, the third and fourth transistors may be matched.

Preferably, the transistors are field effect transistors. The transistors are preferably MOSFETs although they can be any other suitable type of FETs. Alternatively, the transistors may be bipolar transistors.

The current mirror is preferably incorporated in an integrated circuit.

BRIEF DESCRIPTION OF THE DRAWINGS

For a better understanding of the present invention and as to how the same may be carried into effect, reference will now be made by way of example to the accompanying drawings in which.

DETAILED DESCRIPTION OF THE INVENTION

Figure 1:
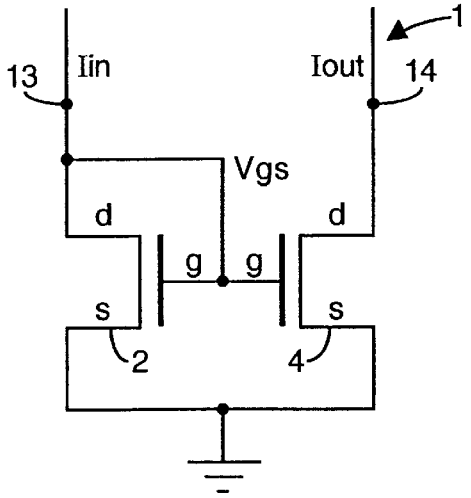
Fig.1. (Prior Art)
FIG. 1 shows a simple current mirror.
Figure 2:
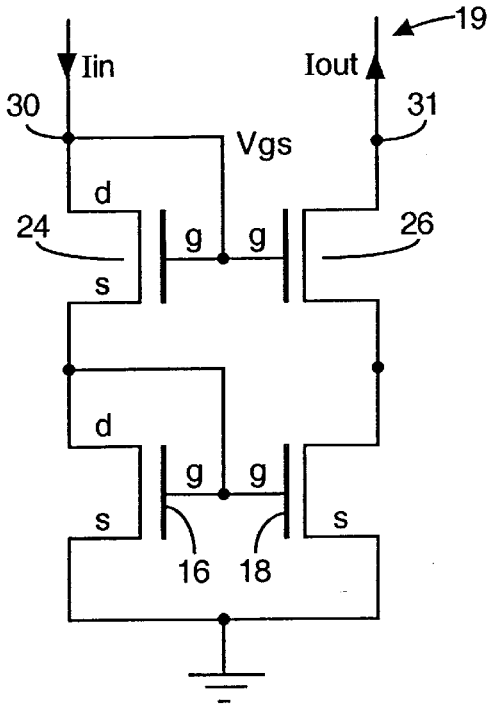
Fig.2. (Prior Art)
FIG. 2 shows a cascode current mirror.
Figure 4:
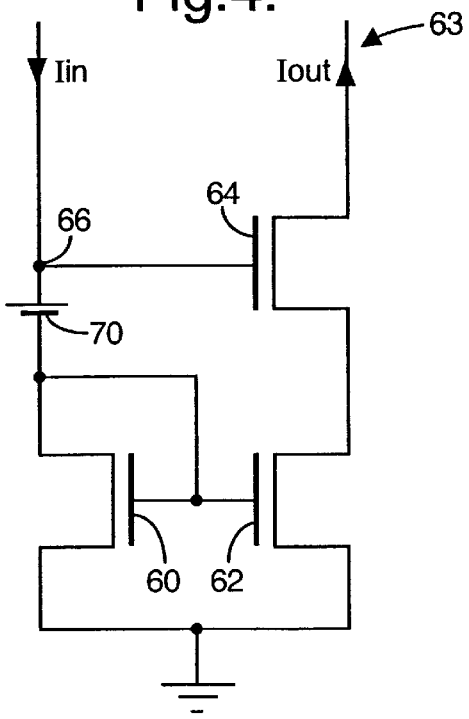
FIG. 4 shows an ideal cascode mirror embodying the present invention.

Reference will first be made to FIG. 4 which shows an "ideal" cascode current mirror 63. The ideal cascode current mirror 63 comprises a matched pair of n-type FETs 60 and 62 having the same connections as the first pair of transistors 16 and 18 of the cascode current mirror shown in FIG. 2. The pair of transistors comprises a first transistor 60 and a second transistor 62. The first and second transistors 60 and 62 have the same characteristics. The sources of both the first and second transistors 60 and 62 are connected to ground. The gates of the first and second transistors 60 and 62 are connected together. The gate and drain of the first transistor 60 are connected.

A third n-type FET 64 is provided on the output side. The gate of the third transistor 64 is connected to an input node 66 which receives the input current Iin. Between the third node 66 for the input current and the drain of the first transistor 60, a floating voltage source 70 is provided. In order to achieve ideal performance, the voltage provided by the floating voltage source should have a magnitude which varies with the transistor characteristics and temperature. In other words, the voltage provided by the voltage source 70 is dependent on the value of the input current Iin. Such a floating voltage source is not easily achievable in practice.

Figure 3:
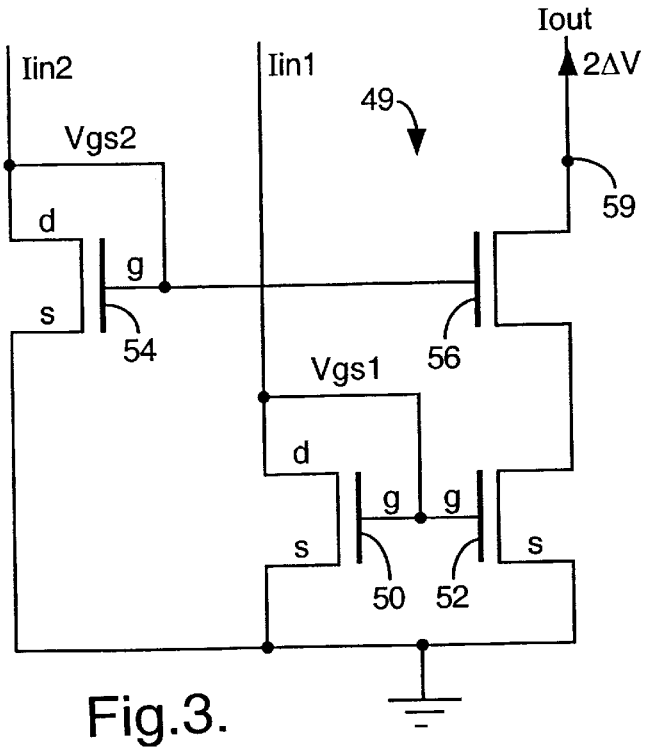
Fig.3. (Prior Art)
FIG. 3 shows a scaled Ids current mirror.

The ideal cascode current mirror only requires a single input current, the input and output currents are equal or nearly equal and the critical voltage required is relatively low. For FETs having similar characteristics to the first, second and fourth transistors of the scaled Ids current mirror shown in FIG. 3, the critical voltage would be equal to $2\Delta V$. Additionally reasonable compensation for changes in temperature would be provided. Changes in temperature may be caused by changes in the temperature of the environment and/or changes in the input current Iin. This arrangement has a critical voltage which is better than that of a cascode mirror.

Figure 5:
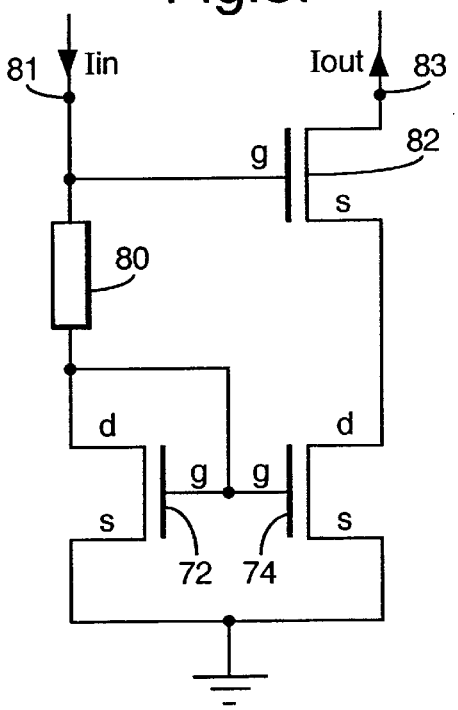
FIG. 5 shows a first embodiment of the present invention.

Reference is now made to FIG. 5 which shows a first embodiment of the present invention. In the arrangement shown in FIG. 5, the floating voltage source 70 of FIG. 4 has been replaced by a resistor 80, the characteristics of which vary with temperature and hence input current Iin. The current mirror shown in FIG. 5 will now be described in more detail. A first pair of transistors 72 and 74 are provided. The sources of the first and second transistors 72 and 74 are connected to ground. The gates of the first and second transistors 72 and 74 are connected together. The source and gate of the first transistors 72 are connected together. The drain of the first transistor 72 is connected to one end of the resistor 80. A third transistor 82 has a gate connected to the other end of the resistor 80. The other end of the resistor 80 is also connected to the input node 81 which receives the input current Iin. The source of the third transistor 82 is connected to the drain of the second transistor 74. The drain of the third transistor 82 is connected to the output node 83 of the current mirror.

When the input current Iin is received, a voltage is applied to the gate of the third transistor 82 which, if large enough, will cause the third transistor 82 to turn on. Additionally, a voltage will be present at the drain of the second transistor 72, the same voltage also being applied to the gates of the first and second transistors 72 and 74. If the voltage is sufficiently large, the first and second transistors 72 and 74 will be turned on. The resistance value of the resistor 80, which is dependent on the temperature, determines the gate voltage which is applied to the first and second transistors 72 and 74 as well as the drain voltage of the first transistor 72. Thus, the alteration of the characteristics of the resistor 80 with temperature provides reasonable compensation the changes in temperature for example resulting from different input currents Iin.

Figure 6:
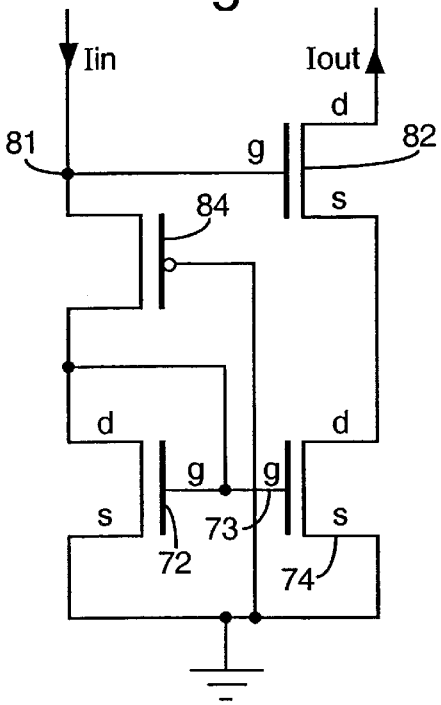
FIG. 6 shows a second embodiment of the present invention.

Whilst the embodiment shown in FIG. 5 is desirable in certain circuits, it is sometimes preferred particularly on integrated circuits not to have any resistive elements. Whilst the resistor 80 provides limited compensation for changes in temperature, such arrangements may not be suitable if a wide range of currents are to be used. FIG. 6 therefore shows a modification to the embodiment shown in FIG. 5. In this modification, the resistor 80 has been replaced by p-type FET 84 which acts as a load. Those parts of the circuit which are the same as those of FIG. 5 are referred to using the same reference numbers.

The p-type FET 84 has its gate connected to ground. The p-type FET 84 is connected in the same position as the resistor of the embodiment shown in FIG. 5, that is between the input node 81 and the drain of the first transistor 72. The effective resistance of the p-type transistor 84 will not perfectly track the changes resulting from changes in temperature in $\Delta V$ of the first and second transistors 72 and 74.

However, the p-type transistor 84 will provide reasonable compensation over a wider range of temperatures and hence input currents Iin as compared to the resistor 80 shown in FIG. 5. In particular, the characteristics of the p-type transistor 84 will change with input current and hence temperature and tracks reasonably well the corresponding changes to the n-type first and second transistors 72 and 74. In other words, the voltage provided at the drain of the first transistor 72 is dependent on the current passing through the p-type transistor 84 which in turn is dependent on the temperature. As the load is in the form of a p-type transistor 84, this more closely matches changes in the operating conditions of the first, second and third transistors 72, 74 and 82 than a resistor.

The first and second transistors are a matched pair. The third transistor 82 may also have the same characteristics as the first and second transistors 72 and 74 although this is not essential.

The body connection of the p-type MOSFET 84 should be connected to its source. This is so as to avoid the body effect. This is because a substrate or body can form a diode junction with the channel. The body or substrate connection causes the substrate or body to be held at a non-conductive voltage. If this connection is made for the p-type transistors, it will not usually be possible for a similar connection to be made for the n-type transistors or vice versa.

The p-type MOSFET may have its control node connected to a voltage other than ground, in alternative embodiments of the invention. It is also possible to replace the p-type MOSFET with an n-type transistor so that all the transistors used are n-type. Alternatively all the transistors used may be p-type.

Figure 7:
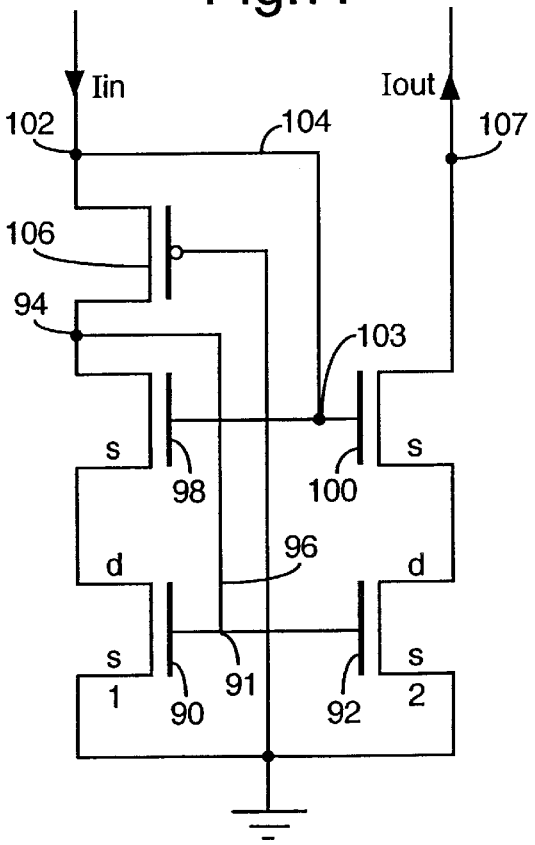
FIG. 7 shows a third embodiment of the present invention.

FIG. 7 shows a third embodiment of the present invention. The arrangement shown in FIG. 5 comprises five transistors. The first pair of n-type FETs 90 and 92 constitute the mirror transistors. The sources of the first and second transistors 90 and 92 defining the first pair are connected to ground and the gates of the first and second transistors 90 and 92 are connected together. A second, cascode, pair of transistors are provided, comprising two n-type transistors 98 and 100. The source of the third transistor 98 is connected to the drain of the first transistor 90. Likewise, the source of the fourth transistor 100 is connected to the drain of the second transistor 92. The gates of the cascode pair of transistors 98 and 100 are connected to each other. The source of the third transistor 98 is connected to the gates of the first and second transistors 90 and 92. An input node 102 receives the input current Iin and is connected to the gates of the third and fourth transistors 98 and 100.

A p-type transistor 106 is also provided between the input node 102 and the source of the third transistor 98. The p-type transistor 106 has its gate connected to ground and is a load transistor. This transistor 106 provides the same function as the p-type transistor 84 of FIG. 6. An output node 107 is provided on the output side and is connected to the drain of the fourth transistor 100. With this arrangement, the voltage across the input mirror transistor, i.e., the first transistor 90 is made equal to that of the output (second) transistor 92. The third and fourth transistors 98 and 100 ensure that the drain voltages of the first and second transistors are equalized. This improves the accuracy of the mirror but does require an additional transistor.

The first and second transistors 90 and 92 define a matched pair. Likewise the third and fourth transistors 98 and 100 define a matched pair of transistors.

The transistors described in the preferred embodiments of the present invention are preferably MOSFETs. However, any other type of transistor can be used, for example other types of field effect transistors or bipolar transistors. It will also be appreciated that where n and p type transistors have been shown, it is possible to construct circuits using transistors of the opposite polarity.

What is claimed is:

1. A current mirror comprising:

an input node for receiving an input current;

an output node for providing an output current;

first, second and third transistors, each transistor comprising first and second current path terminals and a control terminal, the control terminals of the first and second transistors being connected to each other, the first current path terminal of the first transistor and one of the current path terminals of the second transistor being connected to a power supply, the control terminal of the third transistor being connected to the input node, one of the first and second current path terminals of the third transistor being connected to the output node and the other of the first and second current path terminals of the third transistor being connected to the other of the first and second current path terminals of the second transistor; and a resistive element connected in series between the input node and the second current path terminal of the first transistor, the control terminals of the first and second transistors being connected to a node between the resistive element and the second current path terminal of said first transistor, said resistive element being a transistor of the opposite polarity to the first, second and third transistors.

2. A current mirror as claimed in claim 1 wherein a control terminal of the transistor comprising the resistive element is connected to a power source.

3. A current mirror as claimed in claim 1, wherein said first, second and third transistors are n-type transistors.

4. A current mirror as claimed in claim 1, wherein a fourth transistor is provided with one of its current path terminals connected to the second current path terminal of the first transistor and the other of the first and second current path terminals of the fourth transistor connected to one end of the resistive element.

5. A current mirror as claimed in claim 4, wherein the control terminal of the fourth transistor is connected to the control terminal of the third transistor.

6. A current mirror as claimed in claim 4, wherein said fourth transistor is connected between the second terminal of the first transistor and the input node.

7. A current mirror as claimed in claim 4, wherein said fourth transistor has the same polarity of the first, second and third transistors.

8. A current mirror as claimed in claim 4, wherein said fourth and third transistors are matched.

9. A current mirror as claimed in claim 1, wherein said first and second transistors are matched.

10. A current mirror as claimed in claim 1, wherein said transistors are field effect transistors.

11. A current mirror as claimed in claim 10, wherein said transistors are MOSFETs.

12. A current mirror as claimed in any one of claim 1, wherein said transistors are bipolar transistors.

13. An integrated circuit including a current mirror comprising:

an input node for receiving an input current;

an output node for providing an output current;

first, second and third transistors, each transistor comprising first and second current path terminals and a control terminal, the control terminals of the first and second transistors being connected to each other, the first current path terminal of the first transistor and one of the current path terminals of the second transistor being connected to a power supply, the control terminal of the third transistor being connected to the input node, one of the first and second current path terminals of the third transistor being connected to the output node and the other of the first and second current path terminals of the third transistor being connected to the other of the first and second current path terminals of the second transistor; and a resistive element connected in series between the input node and the second current path terminal of the first transistor, the control terminals of the first and second transistors being connected to a node between the resistive element and the second current path terminal of said first transistor, said resistive element being a transistor of the opposite polarity to the first, second and third transistors.

14. A current mirror comprising:

an input node for receiving an input current;

an output node for providing an output current;

first, second, third, and fourth transistors, each transistor comprising first and second current path terminals and a control terminal, the control terminals of the first and second transistors being connected to each other, the first current path terminal of the first transistor and one of the current path terminals of the second transistor being connected to a power supply, the control terminals of the third and fourth transistor being connected to the input node, one of the first and second current path terminals of the third transistor being connected to the output node and the other of the first and second current path terminals of the third transistor being connected to the other of the first and second current path terminals of the second transistor, the first current path terminal of the fourth transistor being connected to the second current path terminal of the first transistor; and a resistive element arranged between the input node and the second current path terminal of the fourth transistor, the control terminals of the first and second transistors being connected to a node between the resistive element and the second current path terminal of said fourth transistor, said resistive element being a transistor of the opposite polarity to the first, second, third, and fourth transistors.

* * * * *